US006621195B2

(12) United States Patent
Fuji et al.

(10) Patent No.: US 6,621,195 B2
(45) Date of Patent: Sep. 16, 2003

(54) SPOT LIGHT-SOURCE DEVICE EXCITED BY ELECTROMAGNETIC ENERGY

(75) Inventors: Hiroyuki Fuji, Sunto-gun (JP); Mitsuru Ikeuchi, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 122 days.

(21) Appl. No.: 09/761,691

(22) Filed: Jan. 18, 2001

(65) Prior Publication Data

US 2001/0008485 A1 Jul. 19, 2001

(30) Foreign Application Priority Data

Jan. 18, 2000 (JP) ..... 2000-009405

(51) Int. Cl.[7] ..... H01J 5/16
(52) U.S. Cl. ..... 313/113; 313/117; 313/324
(58) Field of Search ..... 313/17, 113, 116, 313/117, 317, 324, 634

(56) References Cited

U.S. PATENT DOCUMENTS 3,758,769 A * 9/1973 Pichel ..... 240/442
6,215,254 B1 * 4/2001 Honda et al. ..... 315/246

FOREIGN PATENT DOCUMENTS

JP 6-162807 6/1994
JP 9-017216 1/1997
JP 11-054091 2/1999

* cited by examiner

*Primary Examiner*—Don Wong
*Assistant Examiner*—Thuy Vinh Tran
(74) *Attorney, Agent, or Firm*—Nixon Peabody LLP; David S. Safran

(57) ABSTRACT

To provide a spot light-source device whose discharge envelope has high pressure resistance and that emits high brightness as a spot light source, a spot light-source device excited by electromagnetic energy has a lamp that with a discharge envelope made of translucent non-conducting material, an expansion part forming a discharge space, and a tube connected thereto, and a discharge concentrator having a front tip part which is supported by the tube without protruding from the discharge envelope and faces the interior of the discharge space of the expansion part, that intensifies concentration of the electric field in the discharge space and that concentrates discharge, an electromagnetic energy provision source that excites discharge in the discharge concentrator from outside of the lamp, a concave reflection mirror that reflects light from the lamp, and a container with a resonance window that creates electromagnetic energy resonance. The lamp and the concave reflection mirror are housed with the container, and the contain is constructed to prevent leakage of electromagnetic energy from an aperture that emits light collected light from the lamp and concave reflection mirror.

22 Claims, 10 Drawing Sheets

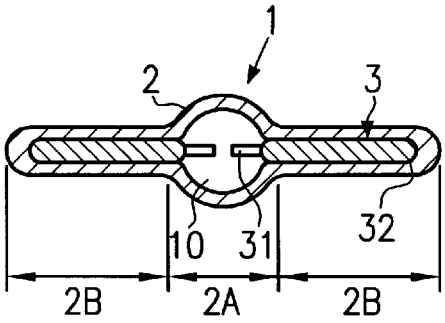
Fig.1
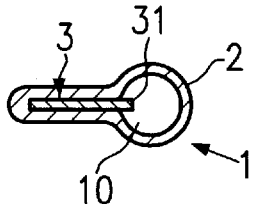
Fig.2
Fig.3(a)
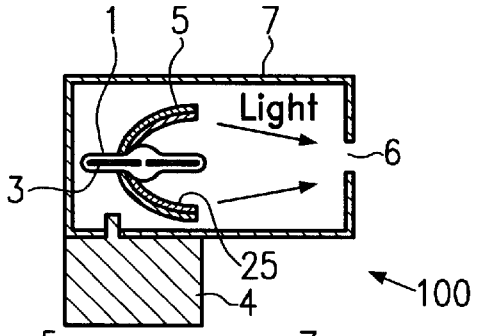
Fig.3(b)
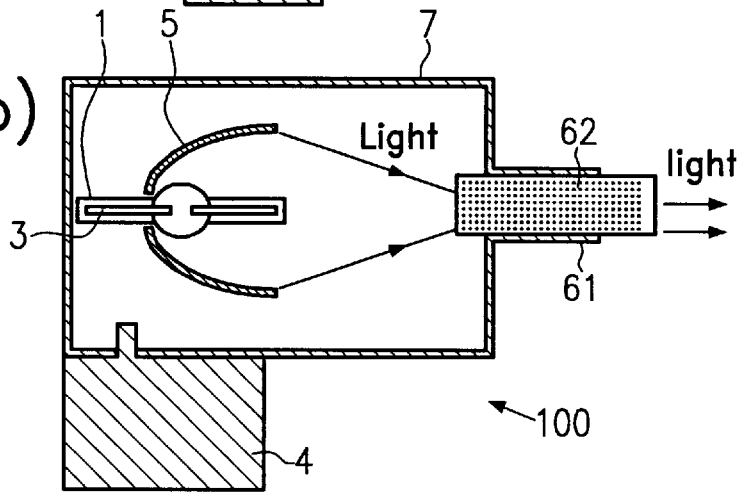
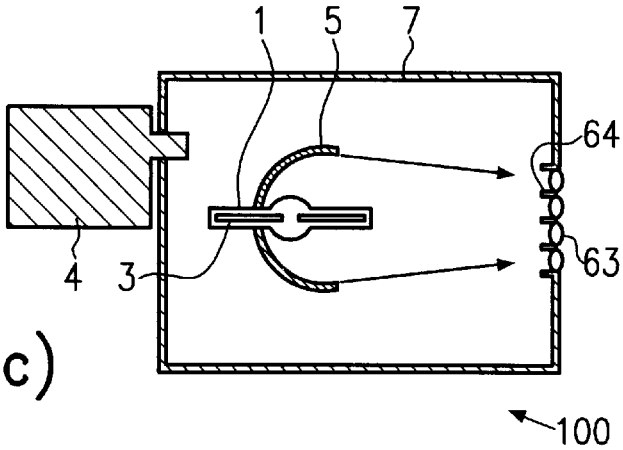
Fig.3(c)
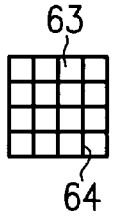
Fig.3(d)

SPOT LIGHT-SOURCE DEVICE EXCITED BY ELECTROMAGNETIC ENERGY

BACKGROUND OF THE INVENTION

1. Field of Invention

The present invention concerns a spot light-source device used in light-sources for liquid-crystal projectors or optical fiber that use spot light-source discharge lamps.

2. Description of Related Art

In recent years, liquid-crystal projectors have come into extensive use as presentation tools at conferences or expositions. Liquid-crystal pictures are projected onto screens via high brightness light sources, but conventional high brightness light-sources for projection by liquid-crystal projectors have had a pair of electrodes facing each other disposed within a discharge envelope made of silica glass. Metal halide lamps having prescribed luminous material sealed within a glass bulb or ultra-high-voltage mercury lamps have been used. Such lamps have been sealed by metal foil seals or rod seals, and external lead members have protruded from such lamps.

However, the demand for greater brightness of projected pictures by liquid-crystal projectors has risen in recent years. Accordingly, higher brightness has also been demanded of light-sources used for projection.

In particular, ultra-high voltage mercury lamps with high sealed pressure foil seals have become the main light source. However, the high brightness that can be attained by light sources is anticipated to reach a limit in the near future since ultra-high voltage mercury lamps sealed by foil seals have limits on the pressure which the sealing sections can withstand.

On the other hand, electrode-free lamps that lack foil seal units as substitute light-sources for projectors have been considered in terms of withstand pressure. An example is the microwave discharge lamp disclosed in the gazette of Japanese Kokai Publication Hei-11-54091. However, such a discharge method is stable tube-wall type discharge in which discharge is generated along the tube walls. The spot light source required of projector light sources is not attained since discharge occurs along the tube walls of a discharge envelope.

In addition, techniques using electrode-free lamps without a foil seal unit as illumination devices are disclosed in the gazettes of Japanese Kokai Publication Hei-6-162807 and Japanese Kokai Publication Hei-9-17216. However, the illumination devices stated in both gazettes are electrode-free lamps. Discharge cannot focus on the lamp center since these are stable tube-wall type discharge lamps similar to those in the gazettes. A spot light source, which is the requisite condition of high brightness discharge lamps, cannot be realized unless the discharge envelopes themselves are miniaturized. Silica glass and alumina which that are material comprising luminous tubes do not permit envelope miniaturization because they can only withstand temperatures under 1200° C.

SUMMARY OF THE INVENTION

Thus, an object of the invention of this application is to provide a spot light-source device for use in the light source of liquid-crystal projectors that employs lamps whose sealing sections can withstand high pressure.

Another object of the invention of this application is to provide a spot light-source device used as the light source of liquid-crystal projectors that employ spot light-source lamps that have high brightness emission.

A further object of the present invention is to provide a spot light-source device used as the light source for liquid-crystal projectors employing a high-brightness lamp as the spot light source whose sealing sections withstand high pressures.

To resolve the mentioned issues, the present invention provides a spot light-source device excited by electromagnetic energy which has a lamp that comprises a discharge envelope made of translucent non-conducting material with an expansion part and a tube connected thereto, and a discharge concentrator in which the front tip part is supported by said tube without protruding from the discharge envelope and faces the interior of the discharge space of said expansion part, that intensifies concentration of the electric field in the discharge space and that concentrates discharge, an electromagnetic energy provision source that excites discharge in the discharge concentrator from outside of the lamp, a concave reflection mirror that reflects light from the lamp, and a container with a resonance window that creates electromagnetic energy resonance within which are housed the lamp and the concave reflection mirror, that is sealed to prevent leakage of electromagnetic energy, and that has an aperture mounted that collects light from the lamp and the concave reflection mirror.

The spot light-source device excited by electromagnetic energy has a cylindrical unit that protrudes from the container with a resonance window at which the aperture is formed, and a rod type integrator is disposed within the cylindrical unit.

Furthermore, the invention also includes the use of a plurality of integrator lenses installed within a lattice reticulated frame at a the aperture. The spot light-source device can be excited by electromagnetic energy and can use a single discharge concentrator. Alternatively, the spot light-source device excited by electromagnetic energy can be provided with two discharge concentrators disposed facing each other, with the discharge concentrator disposed on the bottom side of a curved surface of the concave reflection mirror being shorter than the other discharge concentrator.

The concave reflection mirror of the spot light-source device excited by electromagnetic energy can be provided with a cooling means that cools the lamp, and the lamp can be provided with a cover member to prevent scattering at the aperture side of the concave reflection mirror. Also, an auxiliary optical system having the function of condensing or reflecting radiated light from the lamp can be provided at the aperture side of the concave reflection mirror of the lamp.

The spot light-source device excited by electromagnetic energy of the invention can be disposed vertically with the concave reflection mirror having an aperture at the bottom of its curved surface.

The spot light-source device of the invention can also be provided with a means of matching the impedance of electromagnetic energy within the container with a resonance window. An insulation space can be provided outside of lamp, and the concave reflection mirror can be made of a dielectric material. Preferably, the dielectric material has a dielectric loss at room temperature of less than 0.1. A wavelength selection film is advantageously formed on the inner surface of the concave reflection mirror, which can be made of metal.

The spot light-source device excited by electromagnetic energy of the invention can be provided with a plurality of electromagnetic energy provision sources, and can be also provided with a plurality of lamps within the container with the resonance window. The electromagnetic energy can be provided from the electromagnetic energy provision source (s) to the container with the resonance window via a coaxial cable or via a waveguide.

When electric field energy is provided in the spot light source device pursuant to the present invention, the spot light source facilitates lighting by concentrating the electric field within the discharge space at the tip of the discharge concentrator during the start of discharge, and by constricting discharge to the tip of the concentrator during normal lighting. By maintaining the discharge concentrator only within the discharge envelope, the resistance to the gas pressure within the discharge envelope during lighting is high due to the absence of sealing sections for current induction member, such as an external lead as is found in conventional lamps having electrodes, for the member to be able to conduct current outside of the discharge envelope. Pictures having high brightness and definition can be provided since the spot light-source device for liquid-crystal projectors uses a lamp having such discharge concentrators. In addition, a device free from leakage of electromagnetic energy can be provided.

Further details, objects and advantages of the spot light-source device according to the invention are described in detail below with reference to the accompanying drawings.

BRIEF DESCRIPTION OF THE DRAWINGS

FIG. 1 is a cross-sectional view of an embodiment of a lamp according to the invention.

FIG. 2 is a cross-sectional view of an embodiment of the lamp in accordance with the present invention.

FIGS. 3(*a*)–(*c*) are cross-sectional views showing respective embodiments of the spot light-source device pursuant to the present invention, and FIG. 3(*d*) is a front view of the lens unit of the FIG. 3(*c*) embodiment.

DETAILED DESCRIPTION OF THE INVENTION

Figure 4:
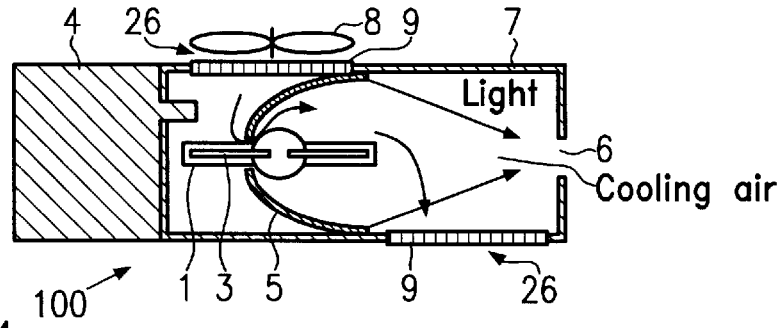
FIG. 4 is a cross-sectional view of another embodiment of the spot light-source device pursuant to the present invention.

The lamp of the spot light-source device pursuant to the present invention is explained first. FIG. 1 shows an envelope 2 of the lamp 1 which is made of a translucent non-conducting material. A prescribed amount of rare gas, such as mercury, as the luminous material, is sealed with a buffer gas within discharge space 10. The discharge envelope 2 has length 2A and tubes 2B are connected at ends thereof. Discharge concentrators 3 are retained within tubes 2B. Discharge concentrators 3 provide electromagnetic energy, intensify the concentration of the electric field within the discharge space 10 during the start of discharge and concentrate discharge to provide a spot light source once discharge reaches normal lighting. The concentrators 3 are disposed facing each other with their front tip parts 31 facing discharge space 10.

Material having a higher threshold temperature for use than the threshold temperature for use of non-conducting material comprising discharge envelope 2 is selected for discharge concentrators 3 because it reaches a high temperature, and a dielectric can be used since conducting material, such as metal, is unnecessary. Metal corroding elements that could not be used if discharge concentrators 3 were made of metal can be used as luminous material if dielectrics are used.

Discharge envelope 2 has no sealing sections since discharge concentrators 3 are supported within tube 2B and do not protrude from discharge envelope 2. Accordingly, it has a high pressure withstanding strength with respect to gas pressure within discharge envelope 2. For example, the operating pressure during lighting of even a lamp having a high amount of mercury sealed within, such as an ultra-high pressure mercury lamp, can be higher than that of a conventional ultra-high pressure mercury lamp having a foil seal structure.

Discharge that takes place in discharge space 11 can be concentrated between front tip parts 31 of discharge concentrators 3 that are separated from the tube walls since the distance separating two front tip parts 31 of discharge concentrators 3 facing each other is narrower than the inner diameter of expansion part 2A of discharge envelope 2.

A means of forcibly cooling the envelope has been required in the past since discharge takes place near the inner surface of the discharge envelope in electrode-free lamps that light with electromagnetic energy and since the tube walls of the discharge envelope reach high temperatures, but discharge takes place away from the tube walls in the lamp pursuant to the present invention that uses a spot light-source device, and the same degree of cooling as found in conventional metal halide lamps and ultra-high pressure mercury lamps that are sealed at both ends is not required.

Furthermore, a pair of discharge concentrators 3 facing each other within discharge space 11 is not essential. Front tip part 31 of a single discharge concentrator 3 may be formed facing discharge space 11, as shown in FIG. 2. The principle is not established in this case, but an electric field is surmised to be concentrated at the tip of the discharge concentrator, discharge commences and when emission intensifies, the arc is surmised to be constricted by the drive energy so that the energy loss due to emission decreases. The utilization efficiency of light can be improved as compared to a lamp having a pair of discharge concentrators through use in conjunction with a concave reflection mirror.

A lamp capable of input of higher emission intensity is possible since the temperature of the section near the plasma can be raised by selecting material for discharge concentrators 3 able to withstand a higher threshold temperature for use than the threshold temperature for use of non-conducting material comprising discharge envelope 2.

As for the shape of discharge concentrator 3, the pressure withstanding strength of tube 2B of discharge envelope 2 can be raised still higher by reducing the diameter of rear tip part 32.

Furthermore, a sealed structure between discharge concentrators 3 and the inner walls of tube 2B through thermal deformation of discharge envelope 2 can be realized by selecting non-conducting material that comprises discharge envelope 2 as well as material having little leakage for discharge concentrators 3, and that permits gap discharge to be inhibited which, in turn, lowers the power loss.

Discharge envelope 2 can be easily shaped and processed if it is made of silica glass. It can be sealed with discharge concentrators 3 because of the high heat resistance characteristics.

Discharge is concentrated at high pressure and an ultra-high brightness spot light source whose color approaches white can be realized when 6 MPa or more of xenon gas is sealed within a discharge envelope at 300 K (room temperature). Making front tip part 31 of discharge concentrators 3 narrow would be an appropriate implementation mode. When front tip part 31 is made narrow, the electric field concentrates at front tip part 31 of discharge concentrators 3 when the lamp commences and discharge is facilitated. In addition, the loss of heat transmitted to discharge concentrators 3 during normal lighting can be reduced.

Furthermore, concentration of the electric field at rear tip part 32 and power loss due to corona discharge can be inhibited by curving rear tip part 32 of discharge concentrators 3.

Discharge envelope 2 is capable of withstanding high pressure when it is constructed of translucent ceramic, such as alumina. For example, 50 to 100 MPa can be enclosed if xenon is used as the luminous material.

Discharge can be conducted and a high brightness spot light source whose color approaches white can be realized by incorporating 300 mg/cc or more of mercury when mercury is used as the sealed luminous material.

The spot light-source lamp pursuant to the present invention using the lamp is explained next. FIGS. 3(*a*) to 3(*c*) are a series of views showing embodiments of the spotlight source device 100 pursuant to the present invention. Lamp 1 is disposed within a container having a resonance window 7 made of metal that covers the electrode so as to approach the midway point between front tip parts 31, 31 of discharge concentrator 3 at the first focal point of concave reflection mirror 5 made of dielectric. An electromagnetic energy provision source 4 is disposed so as to provide electromagnetic energy to the container having a resonance window 7.

The dielectric used in concave reflection mirror 5 has a dielectric loss at room temperature below 0.1. That is because the loss increases due to self heating. Furthermore, a wavelength selective film coats the inner surface of the concave reflection mirror. This wavelength selective film may be constructed of multiple film layers that reflect only visible light, for example. This wavelength selective film has the effect of preventing deterioration due to ultraviolet rays as well as heating due to infrared rays.

The tube 2B of lamp 1 is supported at the bottom of concave reflection mirror 5. The concave reflection mirror 5 that holds lamp 1 is supported within the container with a resonance window, but that support has been omitted from the figures for simplicity. The same applies to the following figures.

In FIG. 3(*a*), reference number 6 denotes an aperture for capturing light. The second focal point of concave reflection mirror 5 is located in or near the center of that aperture. Power is provided to discharge concentrator 3 within lamp 1 by the electromagnetic wave resonance effect when electromagnetic energy is issued from electromagnetic energy provision source 4, and an electric field is concentrated by discharge concentrator 3 in discharge space 11 during the start of discharge, thereby strengthening the electric field. Discharge concentrates between the two front tip parts 31 of the discharge concentrators 3 to create a high-brightness spot light source.

Aperture 6 has a diameter small enough to prevent electromagnetic energy from leaking from the container with resonance window 7. The electromagnetic energy provided from the electromagnetic energy provision source 4 has a frequency band of 10 MHz to 500 MHz.

FIG. 3(*b*) shows an embodiment of spot-light source device 100 that is provided with a cylindrical unit 61 in the section of aperture 6 that captures light and a rod type integrator 62 is disposed therein. In this embodiment, electromagnetic energy does not leak from container 7 with a resonance window because of cylindrical unit 61. Furthermore, the light from lamp 1 that is concentrated at the aperture 6 is made homogeneous so as to advance within rod type integrator 62.

FIG. 3(*c*) shows an embodiment of the spot-light source device 100 having a split integrator 63 comprising a plurality of integrator lenses disposed in a lattice reticulated frame 64 in the section of aperture 6 for capturing light. FIG. 3(*d*) is a front view of split integrator lens 63.

Virtually no light is lost in lattice reticulated frame 64 in this embodiment since the section near the frame that constitutes the connection of split integrator lens 63 does not significantly contribute to transmission of light.

In addition, the concave reflection mirror that concentrates light may be a parabolic mirror rather than an elliptical mirror. In this structure, a lens that focuses light from the lamp that is reflected off a parabolic mirror to form parallel light may be disposed in front of the parabolic mirror at the aperture of the container with a resonance window having a small-diameter hole.

Light can be emitted in the direction of light release of the concave reflection mirror without leakage of electromagnetic energy by installing a mesh of lattice-shaped conducting material at the aperture of the container with a resonance window.

FIG. 4 is a shows an embodiment of the spot-light source device 100 that is provided with intake/discharge ports 26, 26 that are covered by a reticular member 9 that does not leak electromagnetic energy to the container 7 with a resonance window, wherein cooling means 22 is provided at the outside of one aperture.

The lamp used in the spot light-source device pursuant to the present invention differs from conventional electrode-free lamps in that forcible cooling of the discharge envelope walls is not required since discharge is concentrated in the center of the discharge envelope, but concave reflection mirror 5 can be cooled by introducing cooling air within the container 7 with a resonance window via a cooling means as in this embodiment. Inexpensive material having a low heat resistance temperature can be used as the material for the concave reflection mirror as a result. Aperture 6 is a hole whose diameter is small enough to prevent electromagnetic energy from leaking from the container 7 with a resonance window. The figures from FIG. 4 onward omit the wavelength selection film 25 that is shown in FIG. 3.

Figure 5:
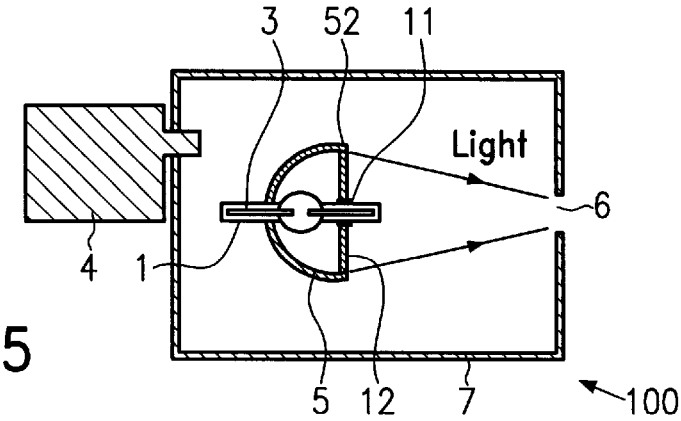
FIG. 5 is a cross-sectional view of still another embodiment of the spot light-source device pursuant to the present invention.

FIG. 5 shows an embodiment of the spot-light source device 100 in which an open front part 52 of the concave reflection mirror 5 is covered by a front glass 12 and in which the gap between front glass 12 and lamp 1 is obstructed by adhesive 11.

The scattering of lamp material can be prevented in this structure if lamp 1 should break. Aperture 6 is a hole whose diameter is small enough to prevent electromagnetic energy from leaking from container 7 with a resonance window.

Figure 6:
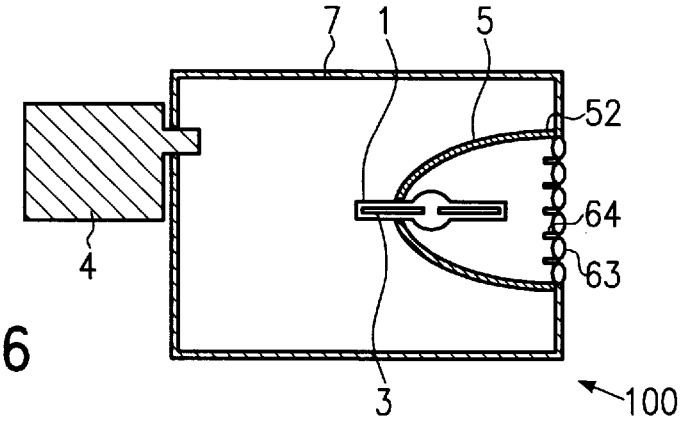
FIG. 6 is a cross-sectional view of a further embodiment of the spot light-source device pursuant to the present invention.

FIG. 6 shows an embodiment of the spot-light source device 100 just like the structure shown in FIG. 3(*c*), but in which the split integrator 63 is wedged into front open part 52 of concave reflection mirror 5 as is, the gap between open front part 52 of concave reflection mirror 5 and split integrator 63 being obstructed. In this manner, the split integrator 63 also doubles as the front glass 12 shown in FIG. 5.

Figure 7:
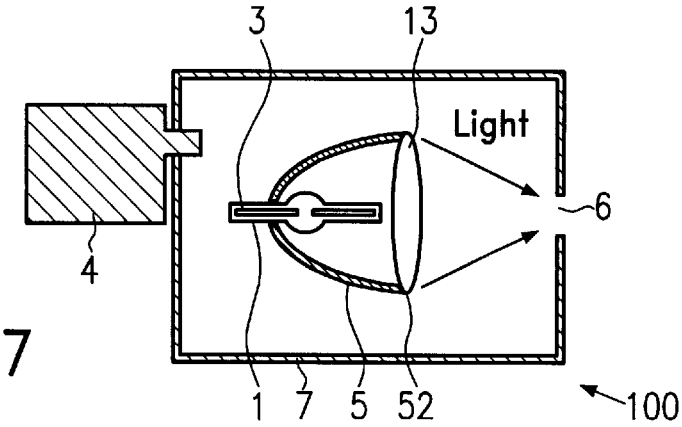
FIG. 7 is a cross-sectional view of yet another embodiment of the spot light-source device pursuant to the present invention.

FIG. 7 an embodiment of the spot-light source device 100 in which a focusing lens 13, that corresponds to the front lens, is disposed in the open front part 52 of concave reflection mirror 5.

The lenses of the spot light-source device embodiments shown in FIGS. 6 & 7 function so as to prevent the scattering of lamp material should the lamp break. The aperture 6 in FIG. 7 is a hole whose diameter is small enough to prevent electromagnetic energy from leaking from container 7 with a resonance window.

Figure 8:
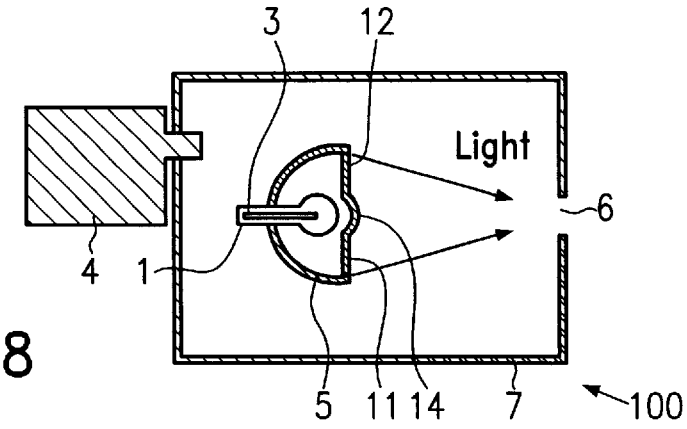
FIG. 8 is a cross-sectional view of another embodiment of the spot light-source device pursuant to the present invention.

FIG. 8 shows an embodiment of the lamp device 100 using a lamp with a single discharge concentrator. An auxiliary reflection mirror 14 is disposed forward of the discharge envelope 2 on the open front side of the concave reflection mirror 5. Auxiliary reflection mirror 14 is spherical and is formed integrally with front glass 12 or is held fixed to front glass 12 by adhesive 11. In this embodiment, the effective solid angle for capturing light is great since only one tube is present in the single discharge concentrator lamp, which increases the optical power.

Since light that is released from the lamp itself toward the front open side of the concave reflection mirror diffuses, light that is not used for diffusion is returned to concave reflection mirror 5 as a result of installing auxiliary reflection mirror 14, and it can be used as effective light. Aperture 6 is a hole whose diameter is small enough to prevent electromagnetic energy from leaking from container 7 with a resonance window.

Figure 9:
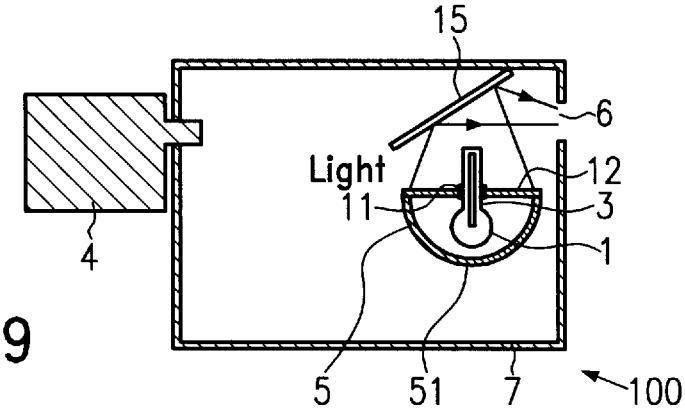
FIG. 9 is a cross-sectional view of still another embodiment of the spot light-source device pursuant to the present invention.

FIG. 9 shows an embodiment using a lamp having a single discharge concentrator just like FIG. 8, but in which the tube of the lamp is mounted vertically and is fixed by adhesive to the overlying front glass 12. Light issued from lamp 1 is condensed by concave reflection mirror 5, looped back by planar reflection mirror 15 and released outward of the container 7 with a resonance window through aperture 6. In addition, concave reflection mirror 5 has no aperture in curved base plate 51. As a result, the condensing area of the reflection mirror can be increased, and the reflected optical power can be increased as compared to the case in which an aperture is present at the base of the curved surface.

Furthermore, the high-temperature part can be situated near the tube during lamp lighting by disposing the tube of the lamp toward the top, as indicated in the figure, and attenuation of optical power due to a loss of permeability of the discharge envelope is reduced. Aperture 6 is a hole whose diameter is small enough to prevent electromagnetic energy from leaking from container 7 with a resonance window.

Figure 23:
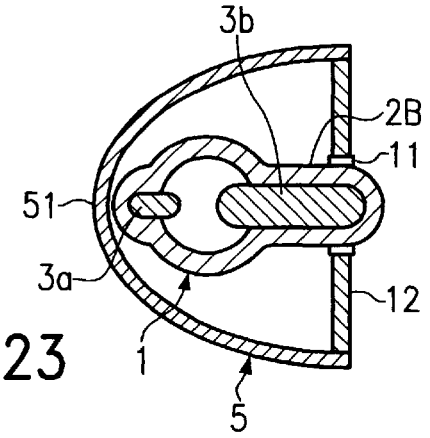
FIG. 23 is a cross-sectional view of an embodiment in which the concave reflection mirror is combined with the spot light-source device pursuant to the present invention.

When using a lamp that has two discharge concentrators, by placing the discharge concentrator 3*a* on the side of curved base plate 51 of concave reflection mirror 5 instead of the second discharge concentrator 3*b*, as shown in FIG. 23, a structure without an aperture in curved base plate 51 of concave reflection mirror 5 can be produced just like the structure shown in FIG. 9 which uses one discharge concentrator. In this case, the front glass 12 is bonded by adhesive 11 at tube 2B that supports second discharge concentrator 3*b* in lamp 1.

Figure 10:
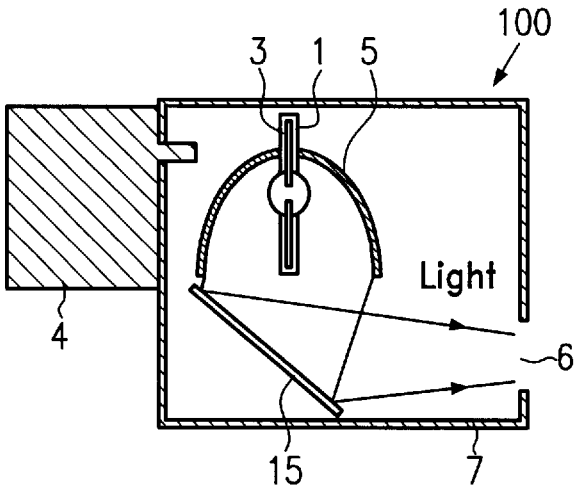
FIG. 10 is a cross-sectional view of an embodiment of the spot light-source device pursuant to the present invention with a vertically oriented lamp.

FIG. 10 shows an embodiment of the spot light-source device 100 in which a lamp having two vertically supported discharge concentrators is lit. The light issued from lamp 1 is condensed by concave reflection mirror 5 and is reflected back by planar mirror 15. It is then released outward from container 7 with a resonance window via aperture 6, which is a hole whose diameter is small enough to prevent electromagnetic energy from leaking from container 7 with a resonance window.

Figure 11:
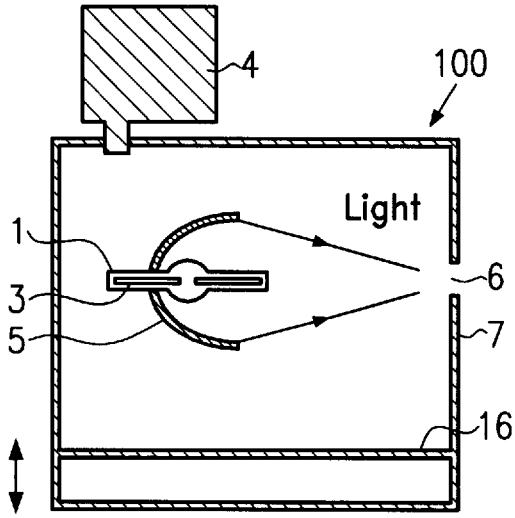
FIG. 11 is a cross-sectional view of an embodiment of the spot light-source device pursuant to the present invention with an impedance matching wall section.
Figure 12:
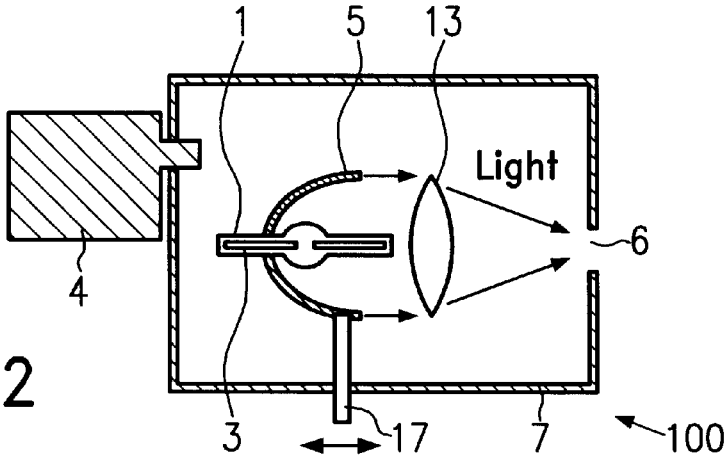
FIG. 12 is a cross-sectional view of an embodiment of the spot light-source device pursuant to the present invention with a spatial adjustment mechanism.
Figure 13A:
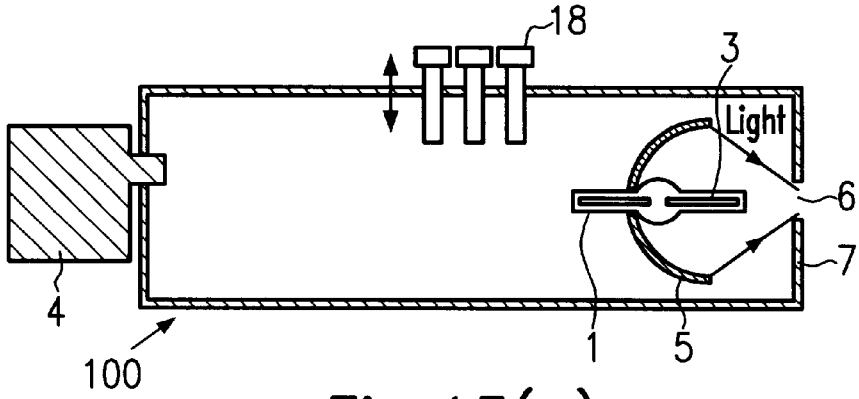
FIGS. 13(*a*) & 13(*b*) are cross-sectional views of embodiments of the spot light-source device pursuant to the present invention with three impedance matching stops and one impedance matching stop, respectively.
Figure 13B:
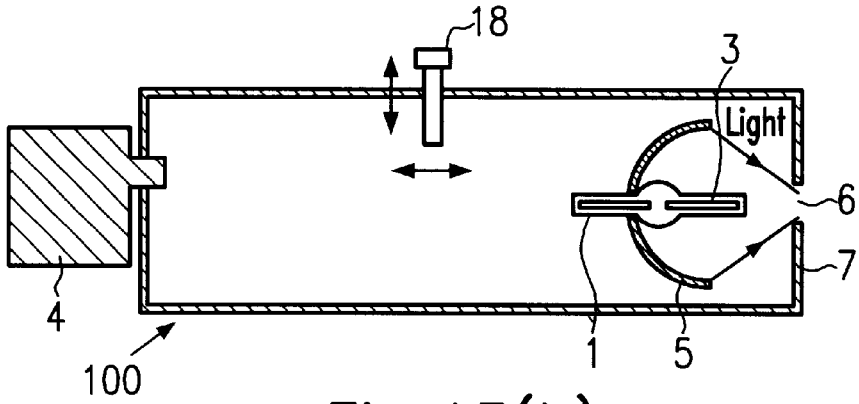

FIGS. 11 to 13 show embodiments of spot light-source device 100 with a means for selecting the optimal electromagnetic energy matching conditions. The matching conditions are altered by changing the volume of the container with a resonance window through moving impedance matching wall section 16 within container 7 with a resonance window in the direction denoted by the arrows in FIG. 11. Lamp 1 is adjusted to the optimum position, specifically, impedance matching is carried out and light is released efficiently. Aperture 6 is a hole whose diameter is small enough to prevent electromagnetic energy from leaking from container 7 with a resonance window.

FIG. 12 shows an embodiment in which lamp 1 and concave reflection mirror 5 are both moved. The spatial relationship between lamp 1 and the container 7 with a resonance window is altered by moving lamp 1 and concave reflection mirror 5 in the direction denoted by the arrows and impedance matching is completed. That enables light to be efficiently released through focusing lens 13. Aperture 6 is a hole whose diameter is small enough to prevent electromagnetic energy from leaking from container 7 with a resonance window.

FIGS. 13(*a*) & 13(*b*) show an embodiment in which impedance matching is carried out using stops. Impedance matching is carried out in these structures by altering the length of protrusion of stops into the container with a resonance window, thereby changing the gap between the stops and the container with a resonance window to permit efficient light release. Aperture 6 is a hole whose diameter is small enough to prevent electromagnetic energy from leaking from container 7 with a resonance window.

Figure 14:
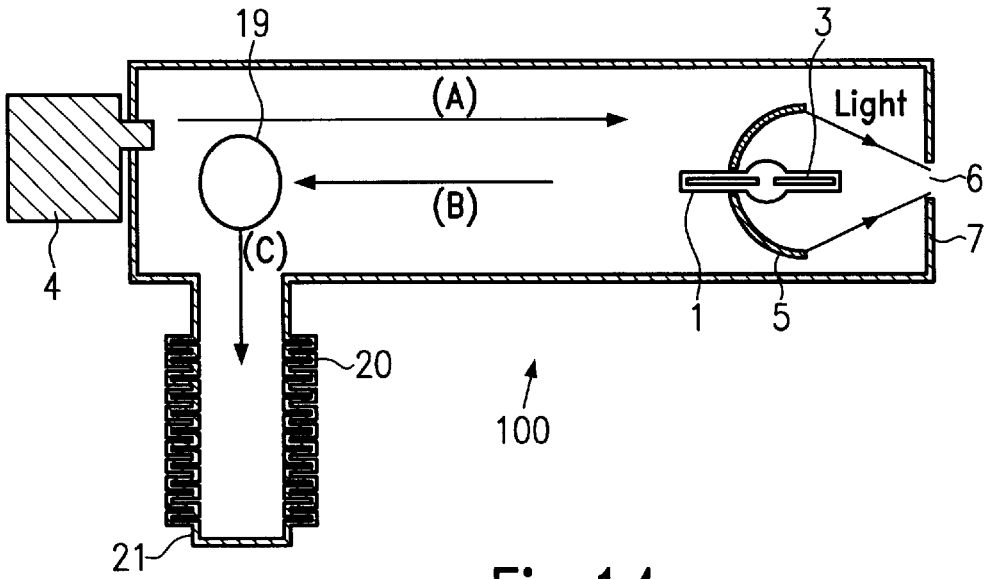
FIG. 14 is a cross-sectional view of an embodiment of the spot light-source device pursuant to the present invention with an electromagnetic energy absorption tube.

FIG. 14 shows an embodiment of the spot light-source device 100 in which a circulator 19 is used to eliminate the return of electromagnetic energy to electromagnetic energy provision source 4 in order to protect the electromagnetic energy provision source 4.

In this example, electromagnetic energy oscillated from electromagnetic energy provision source 4 reaches lamp 1 via path (A), whereupon lamp 1 fires as a high-brightness spot light source between two discharge concentrators. Then, electromagnetic energy reflected off the concave reflection mirror, the lamp and the inner walls of the container with a resonance window returns toward electromagnetic energy provision source 4 via path (B). The returning electromagnetic energy is deflected in direction (C) into the electromagnetic energy absorption tube 21 by the circulator 19 and advances in that direction. The energy is absorbed within electromagnetic energy absorption tube 21. Cone-shaped members that are not illustrated are disposed within the electromagnetic energy absorption tube 21. Reference number 20 denotes a discharge lamp. In this implementation mode, aperture 6 is a hole whose diameter is small enough to prevent electromagnetic energy from leaking from container 7 with a resonance window.

Figure 15A:
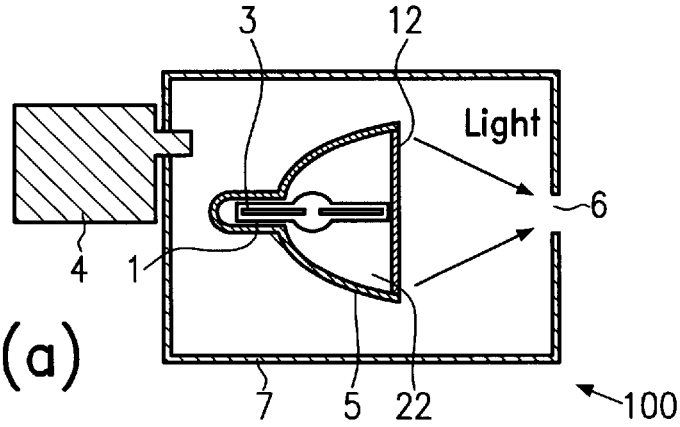
FIGS. 15(*a*) & 15(*b*) are cross-sectional views of embodiments of the spot light-source device pursuant to the present invention with cooling means.
Figure 15B:
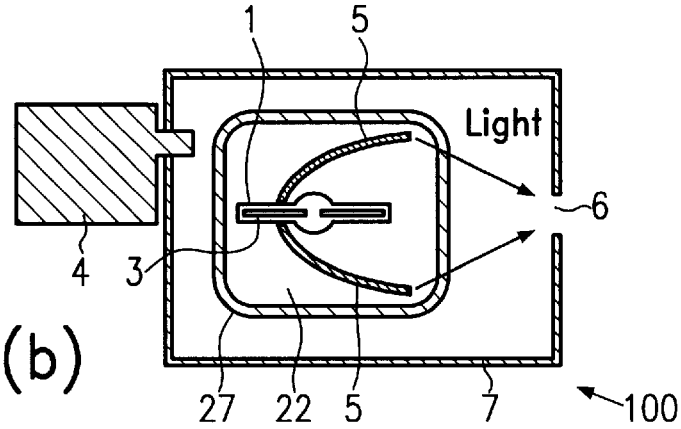

FIGS. 15(*a*) & 15(*b*) show embodiments of the spot light-source device 100 that have cooling means 22 about the lamp. Cooling means 22 forms a vacuum, and is formed by sealing the lamp 1 within concave reflection mirror 5 by joining the front glass 12 to the front of the of the reflection mirror 5 and entending the bottom of concave reflection mirror 5 around the discharge concentrator 3 which extends rearwardly through the reflection surface of mirror 5, in FIG. 15(*a*).

The cooling means 22 in FIG. 15(*b*) is formed by sealing and disposing the lamp 1 and concave reflection mirror 5 within an insulation space formation unit 27. In this embodiment as well, aperture 6 is a hole whose diameter is small enough to prevent electromagnetic energy from leaking from container 7 with a resonance window. The heat loss is slight in the implementation mode shown in FIGS. 15(*a*) & 15(*b*) and an efficient lamp can be completed by lighting the lamp in a vacuum.

Figure 16:
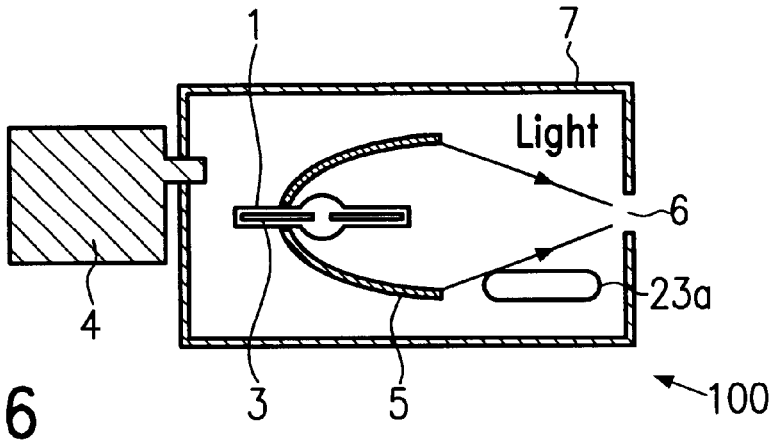
FIG. 16 is a cross-sectional view of an embodiment of the spot light-source device pursuant to the present invention with an auxiliary ultraviolet light source.

FIG. 16 shows an embodiment of the spot light-source device 100 that has a spot-light auxiliary ultraviolet light source 23*a*. An electrode-free, low-pressure lamp is provided as the spot-light auxiliary ultraviolet light source 23*a* in FIG. 16. Spot-light auxiliary ultraviolet light source 23*a* is started by electromagnetic energy, ultraviolet light is released, and good starting pressure are realized by the fact that lamp receives the ultraviolet light. Aperture 6 is a hole whose diameter is small enough to prevent electromagnetic energy from leaking from container 7 with a resonance window.

Figure 17A:
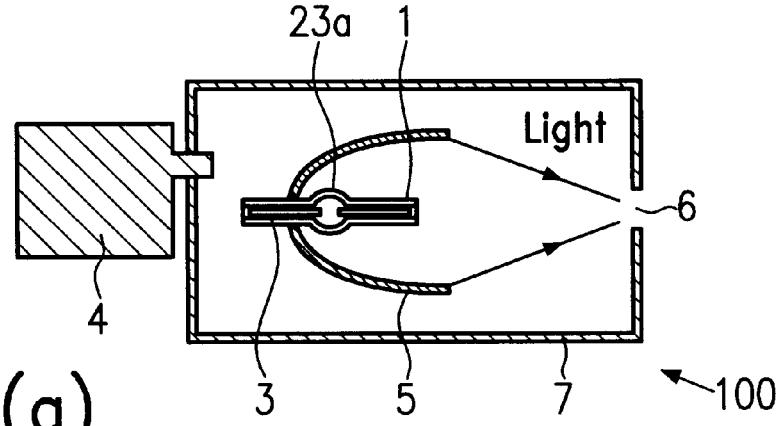
FIG. 17(*a*) is a cross-sectional view of an embodiment of an overlapping tube type spot light-source device pursuant to the present invention, and FIGS. 17(*b*) & 17(*c*) are longitudinal and transverse cross-sectional views, respectively, of the lamp tube of the device shown in FIG. 17(*a*), FIG. 17(*c*) being a view along line I—I in FIG. 17(*b*).
Figure 17B:
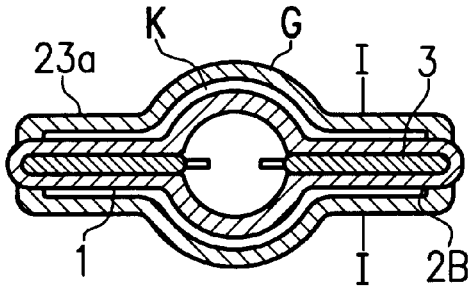
Figure 17C:
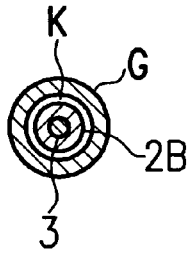

FIGS. 17(*b*) & 17(*c*) show a so-called overlapping type lamp tube. Lamp 1 is disposed within an outer tube G, and rare gas is sealed in the space K that is formed between outer tube G and the outer walls of the discharge envelope of lamp 1, as shown in FIG. 17(*b*). An electrode-free, low-pressure discharge lamp (spot-light auxiliary ultraviolet light source 23*a*) is provided about the periphery of lamp 1 as the starting improvement means 23. In this case as well, spot-light auxiliary ultraviolet light source 23*a* is started by electromagnetic energy, just like the mode shown in FIG. 16, ultraviolet light is released, and the starting properties are improved by having lamp 1 receive the ultraviolet light.

Figure 18:
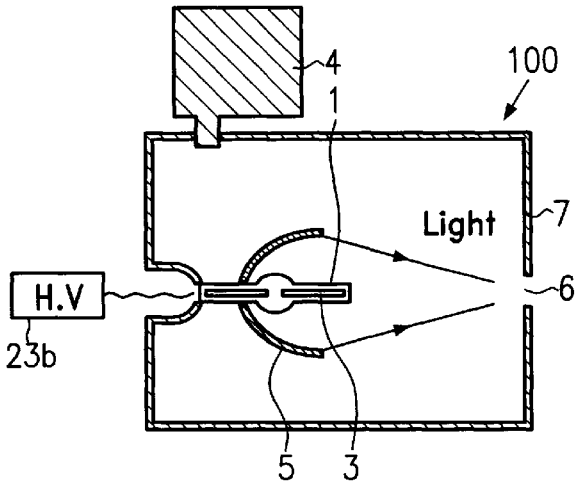
FIG. 18 is a cross-sectional view of an embodiment of the spot light-source device pursuant to the present invention with an auxiliary high voltage source.

FIG. 18 shows the disposition of spot-light auxiliary high voltage source 23*b* near the tube of lamp 1 as the starting improvement means 23. The starting properties are enhanced by applying high voltage.

In both FIGS. 17 & 18, the aperture 6 is a hole whose diameter is small enough to prevent electromagnetic energy from leaking from container 7 with a resonance window.

Figure 19:
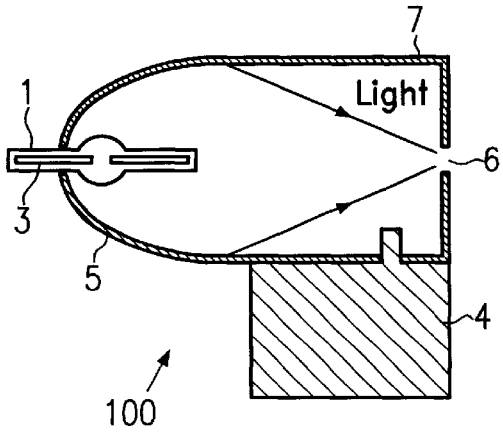
FIG. 19 is a cross-sectional view of an embodiment of the spot light-source device pursuant to the present invention in which the reflection mirror functions as the container with an aperture window.

FIG. 19 shows an embodiment of the spot light-source device 100 utilizing a metal reflection mirror as concave reflection mirror 5 in which reflection mirror 5 functions as the container 7 with a resonance window. The reflection mirror can form part of the container with a resonance window when a metal reflection mirror is used, and that simplifies the structure of a spot light-source device.

Figure 20:
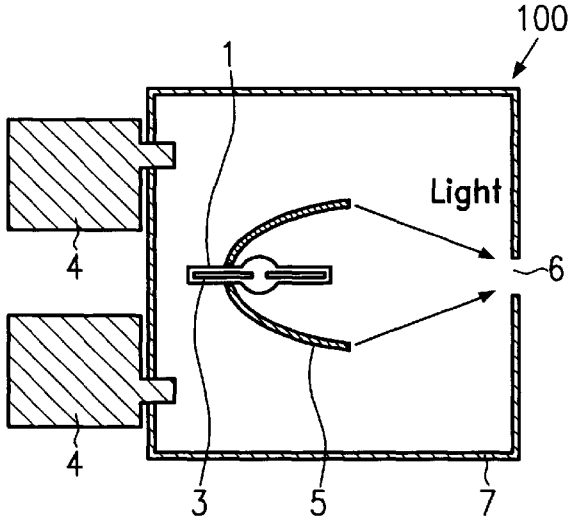
FIG. 20 is a cross-sectional view of an embodiment of the spot light-source device pursuant to the present invention with multiple electromagnetic energy provision sources.

FIG. 20 shows one example of an embodiment of the spot light-source device 100 in which a plurality of electromagnetic energy provision sources 4 are provided. In the diagram, the spot light-source device is provided with two electromagnetic energy provision sources 4. Electromagnetic energy can be overlapped, permitting lighting of a high output lamp utilizing inexpensive electromagnetic energy provision sources.

Figure 21:
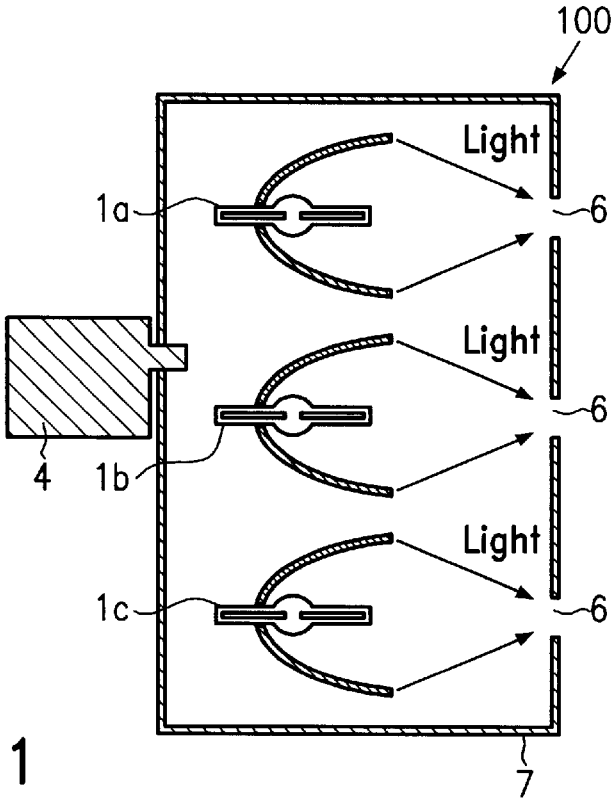
FIG. 21 is a cross-sectional view of an embodiment of the spot light-source device pursuant to the present invention with multiple lamps.

FIG. 21 shows an embodiment of the spot light-source device 100 in which a plurality of lamps are provided. In the figure, the sealed material is altered for controlling the emitted wavelength via first lamp 1*a*, second lamp 1*b* and third lamp 1*c* so that R (red), G (green), B (blue) light is captured from the respective lamps, and a well-balanced RGB color can be realized by altering the resonance status of each lamp. The brightness of light irradiated from the spot light-source device can be made uniform at the irradiated surface by using a plurality of lamps. In this embodiment, aperture 6 is a hole whose diameter is small enough to prevent electromagnetic energy from leaking from container 7 with a resonance window.

Figure 22A:
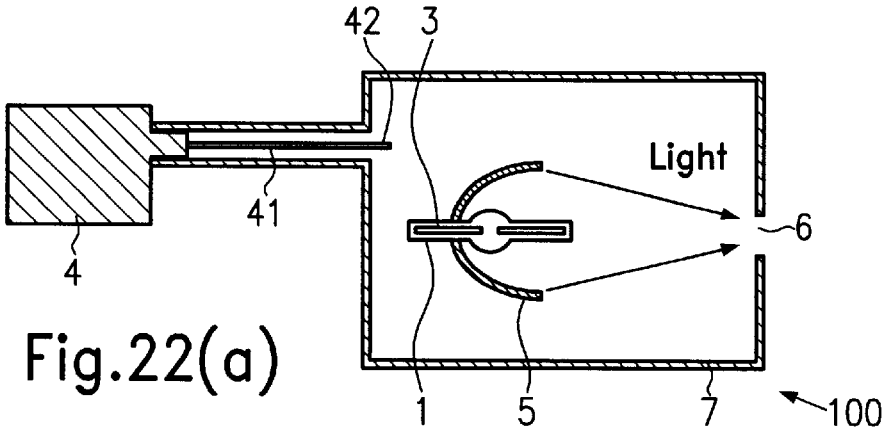
FIGS. 22(*a*) & 22(*b*) are cross-sectional views of embodiments of the spot light-source device pursuant to the present invention using a coaxial cable and a waveguide, respectively.
Figure 22B:
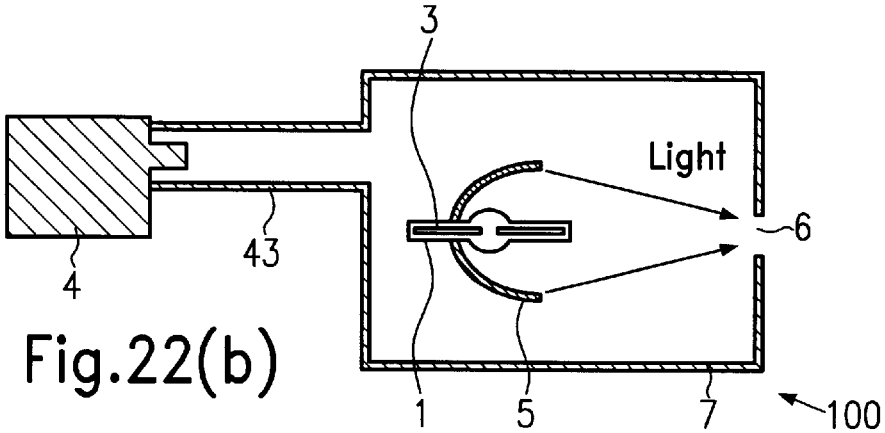

FIG. 22(*a*) shows an embodiment of the spot light-source device 100 that uses coaxial cable 41. FIG. 22(*b*) shows an embodiment of the spot light-source device 100 that uses a waveguide 43.

The use of coaxial cable 41 and waveguide 43 permits lighting of lamp 1 by electromagnetic energy provision source 4 even if they are separated. The front tip part 42 of the coaxial cable 41 is exposed in container 7 in FIG. 22(*a*). In the embodiments of FIGS. 22(*a*) & 22(*b*), the aperture 6 is a hole whose diameter is small enough to prevent electromagnetic energy from leaking from container 7 with a resonance window.

EXAMPLES

A concrete example of the spot light-source device 100 shown in FIG. 3 is explained using FIGS. 1 & 3.

A Lamp 1 comprising a discharge envelope 2 made of silica glass was disposed within a container 7 with a resonance window that provides an electromagnetic shield. Electromagnetic energy provision source 4 was disposed so as to provide electromagnetic energy to the container 7. The lamp power was 200 W. The discharge envelope 2 was 2.5 mm thick, with a 12 mm outer diameter of expansion part 2A. Discharge concentrators 3 were made of tungsten. The diameter of the thick part within the tube was 2 mm, and the distance separating the tips 1.5 mm.

A thin rhenium film that has less wetting properties than silica glass was used to cover the surface of discharge concentrator 3 that is present within the tube outside of the section that is exposed to discharge space 10. The condensing concave reflection mirror 5 was made of glass and ceramic which are dielectric materials. A wavelength selection film 25 comprising a multi-layered dielectric film of titania ($TiO_2$) and silica ($SiO_2$) was formed on the surface for reflecting visible light.

The sealed material within discharge envelope 2 was Ar 13 kPa, mercury 300 mg/cc. The frequency of the electromagnetic energy source is 2.45 GHz. The frequency of the electromagnetic energy source that was used is in the range of 100 MHz to 50 GHz. Container 7 with a resonance window was made of metal, such as aluminum, copper or brass.

When spot light-source device 100 having the structure shown in FIG. 3 was manufactured pursuant to the specifications, and disposed so that the first focal point of concave reflection mirror 5 was located between the tips of discharge concentrators 3, and a 2.45 GHz frequency applied, lighting occurred as a bright white spot light source between the tips of discharge concentrators 3. The light that reflected off concave reflection mirror 5 was released from aperture 6 that is located near the second focal point of the concave reflection mirror.

Figure 25:
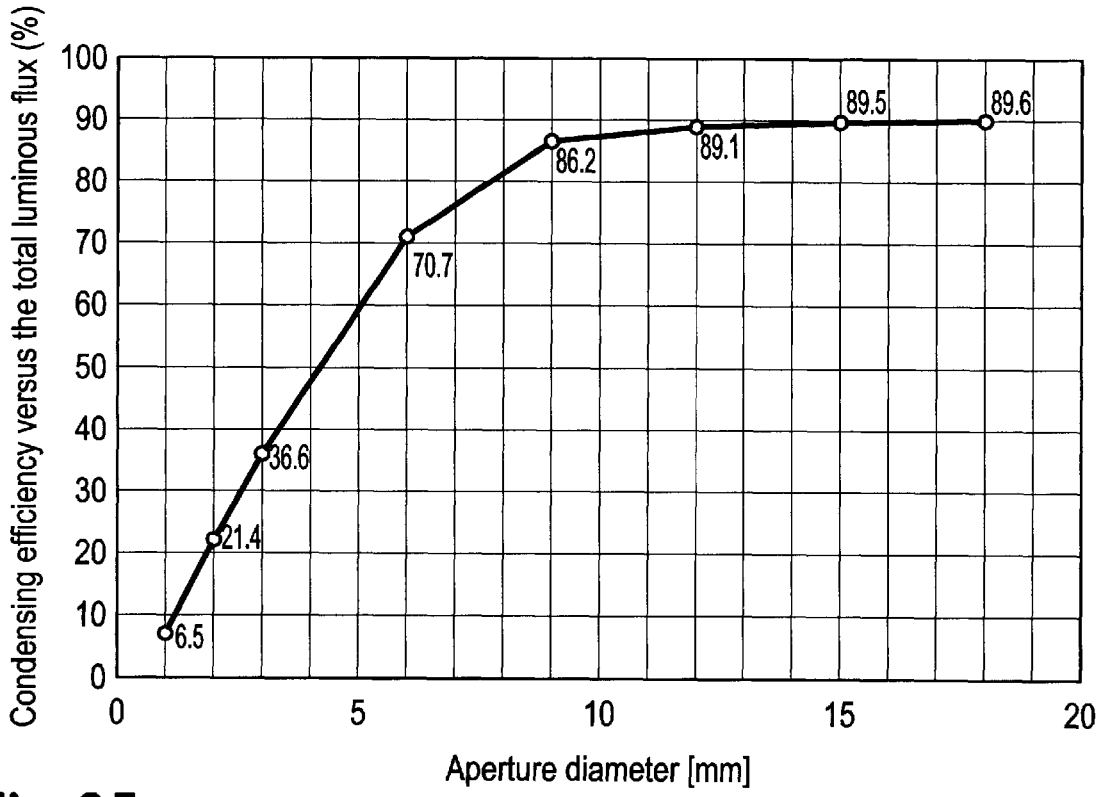
FIG. 25 is a graph showing the condensing efficiency at the aperture of the container with a resonance window as a function of aperture diameter.
Figure 26:
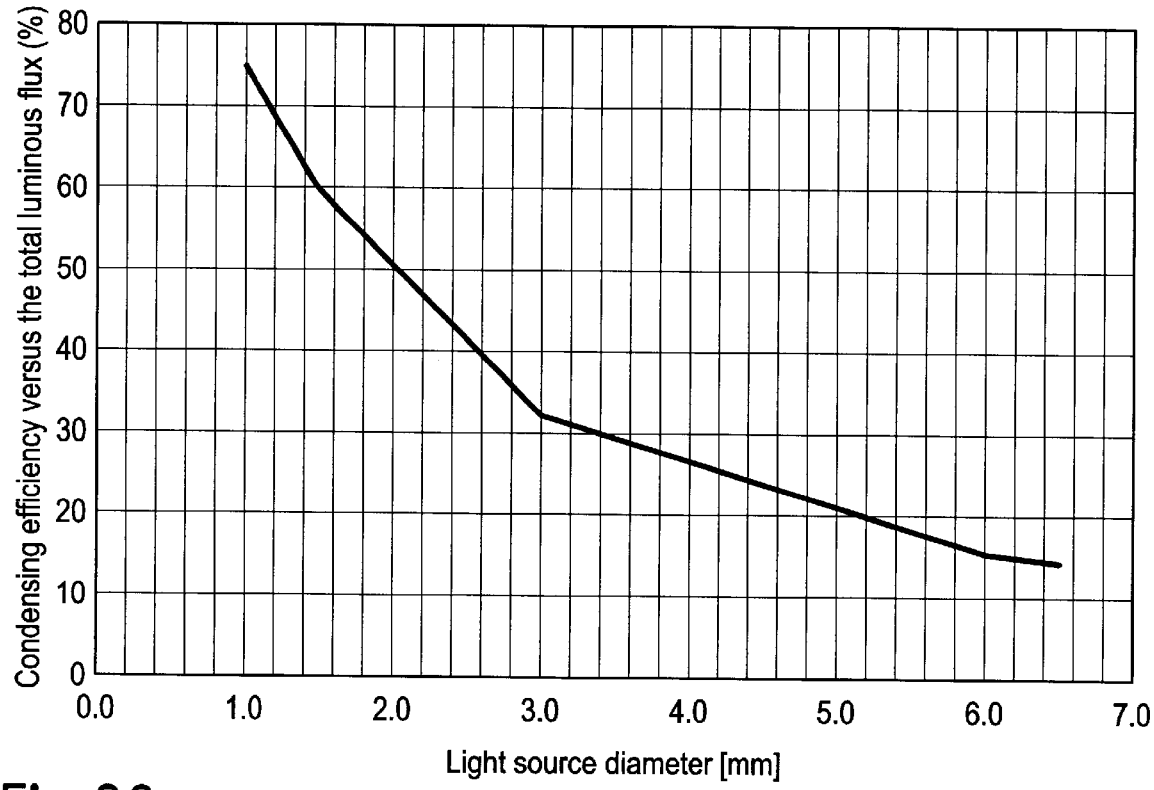
FIG. 26 is a graph showing the condensing efficiency at the aperture of the container with a resonance window as a function of light source diameter.

FIG. 25 shows the proportion of condensing (condensing efficiency) of the total luminous flux of the bright spot light source at aperture 6 that developed between the tips of the discharge concentrators. FIG. 26 shows the proportion of condensing (condensing efficiency) of the total luminous flux at aperture 6. About 60% of the total luminous flux of the lamp could be condensed at aperture 6 that was located at the second focal point when the diameter of aperture 6 of container 7 with a resonance window was 5 mm in the embodiment in which the separation between the tips of the discharge concentrator was 1.5 mm (approximate size of the light source=light source diameter), as shown in FIG. 25. Furthermore, 70% of the total luminous flux of the lamp could be condensed at aperture 6 which was located at the second focal point by setting the diameter of aperture 6 at 6 mm.

FIG. 26 shows the proportion of condensing (condensing efficiency) of the total luminous flux at aperture 6 of 5 mm diameter of container 7 with a resonance window derived from light sources that have different diameters.

The size of the light source (light source diameter) in a conventional electrode-free lamp is the inner diameter of the discharge envelope. Only 15% of the total luminous flux of the lamp can be condensed at aperture 6 that is located at the second focal point when the inner diameter is set at 6 mm (light source diameter) and the diameter of aperture 6 of container 7 with a resonance window is set at 5 mm, as shown in FIG. 26. A spot light source cannot be developed unless the discharge envelope itself is miniaturized to increase this condensing rate. Miniaturization of the envelope is impossible since the silica glass or alumina comprising the luminous tube have a heat resistant temperature under 1200° C. In the present invention, the light source diameter can be reduced to 1.5 mm and 60% of the total luminous flux of the lamp can be condensed at aperture 6 that is located at the second focal point.

Such deficiencies as darkening of the tube walls of the discharge envelope and breakage of the discharge envelope following lighting did not occur. The pressure within the discharge envelope during discharge is expected to exceed 30 MPa since 300 mg/cc of mercury are sealed within and since 13 kPa of rare gas are sealed as buffer gas. The pressure resistance of the discharge envelope 2 is concluded to increase compared to a conventional ultra-high pressure mercury lamp provided with electrodes and a foil seal.

Electrode-free low-pressure discharge lamp 23*a* mounted about the periphery of lamp 1 shown in FIGS. 16 & 17 should have rare gas (argon) sealed within the discharge envelope made of (silica glass) and the sealing pressure should be (1.3 kPa).

The individual lamps 1*a*, 1*b*, 1*c* to fortify the red, green, blue comprising discharge envelope 2 of silica glass shown in FIG. 21 are disposed within container 7 with a resonance window that provides an electromagnetic shield. The lamp power is 100 W, the discharge envelope is 2.5 mm thick, and the 10 mm outer diameter of the expansion part is made of silica glass. Discharge concentrators 3 are made of tungsten, the inner diameter of the thick part within the tube is 0.4 mm, and the separation between the tips is 1.2 mm. A thin rhenium film that has less wetting properties than silica glass is used to cover the surface of discharge concentrator 3 that is present within the tube outside of the section that is exposed to discharge space 10. Reference number 5 denotes a condensing concave reflection mirror made of glass and ceramic which are dielectric materials. Wavelength selection film 25 comprising a multi-layered dielectric film of titania ($TiO_2$) and silica ($SiO_2$) is formed on the surface. This film has the function of reflecting visible light. Aperture 6 is a hole whose diameter is small enough to prevent electromagnetic energy from leaking.

The sealed material within discharge envelope 2 is Ar 13 kPa, mercury 100 mg/cc, 0.5 mg of lithium iodide in the lamp to fortify red, 0.2 mg of titanium iodide to fortify green, and 0.3 mg of indium iodide to fortify blue. The frequency of the electromagnetic energy source is 2.45 GHz. The frequency of the electromagnetic energy source that is used is in the range of 100 MHz to 50 GHz. Container 7 with a resonance window is made of metal such as aluminum, copper or brass.

When spot light-source device 100 having the structure shown in FIG. 21 was manufactured pursuant to the specifications, was disposed so that the first focal point of the concave reflection mirror was located between the tips of the discharge concentrators, and 2.45 GHz frequency was applied, lighting was produced as a bright spot light source having fortified R, G, B near the tips of the discharge concentrators. The light reflected off of the concave reflection mirror 5 was released from aperture 6 that was located near the second focal point of the concave reflection mirror.

Figure 24:
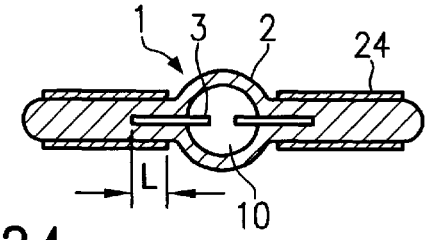
FIG. 24 is a cross-sectional view of an embodiment of the lamp pursuant to the spot light-source device of the present invention.

The spot light-source device pursuant to the present invention utilizes discharge due to electromagnetic energy resonance, and discharge concentrators 3 functions as a reception member. Thus, the pressure resistance reliability of tube 2B can be increased by installing a reception member 24 that is separate from discharge concentrators 3 outside of discharge envelope 2 as shown in FIG. 24. That also enables the heat loss due to the discharge concentrator to be reduced. The overlapping width of discharge concentrators 3 and reception member 24 in the tube axial direction (L of FIG. 24) can be reduced enough to pose no problems since the frequency is high. Discharge concentrators 3 and reception member 24 can be linked by electrostatic capacity.

The brightness is high and vivid pictures can be provided since the spot light-source device pursuant to the present invention common to each embodiment is a spot light source device for liquid-crystal projectors, etc., that use lamps having discharge concentrators. Furthermore, a device free from electromagnetic energy leakage can be provided.

The spot light-source device pursuant to the present invention can be also be used as an ultraviolet curing device that use optical fibers.

Effects of Invention

As explained above, in the spot light-source device pursuant to the present invention, the discharge concentrator concentrates the electric field within the discharge space when discharge commences and discharge becomes a spot light source when normal lighting is reached. The discharge concentrator is supported only within the discharge envelope so that there are no sealing sections outside of the discharge envelope of the member for current induction, such as an external lead as is found in conventional lamps having electrodes. As a result, the pressure withstanding strength to gas pressure within the discharge envelope during discharge is high. Discharge is concentrated at the tip of the discharge concentrator to permit a bright spot light source since the discharge concentrator within the lamp is structured so as to face the discharge space. A spot light-source device that can be adequately used as a bright spot light-source device can be provided.

A cylindrical unit that protrudes outward of the container with a resonance window is formed at the aperture of the container with a resonance window. When a rod-shaped integrator is disposed within the cylindrical unit, a spot light-source device can be provided that eliminates leakage of electromagnetic energy, that permits highly uniform light to be realized, and that can be adequately used as a bright spot light source device.

Furthermore, light can be captured outside of the container with a resonance window without loss of light at the lattice reticulated frame when a plurality of integrator lenses are installed within a lattice reticulated frame at the aperture of the container with a resonance window.

When a lamp is structured using a single discharge concentrator, the utilization efficiency of light is improved compared to a spot light-source device using a pair of discharge concentrators.

Furthermore, a concave reflection mirror without any aperture at the curved surface of the concave reflection mirror can be used and the utilization efficiency of light can be improved by disposing two discharge concentrator facing each other and by setting the discharge concentrator disposed on the side of the bottom of the curved surface of the concave reflection mirror shorter than the other discharge concentrator.

A spot light-source device having still higher input can be realized by providing a cooling means that cools the lamp and the concave reflection mirror.

Furthermore, a safe spot light-source device which prevents the scattering of lamp material should the discharge envelope break can be obtained by providing a covering member to prevent scattering of constituents of the lamp on the front aperture side of the concave reflection mirror.

The utilization efficiency of light can be enhanced further by providing an auxiliary optical system having the function of condensing or reflecting light released from the lamp on the side of the aperture at the front of the concave reflection mirror of the lamp.

Furthermore, the high-temperature part can be set closer to the tube during lamp lighting by disposing the lamp vertically, and that permits attenuation of the optical power due to a loss of permeability of the discharge envelope to be reduced.

The lamp can be lit under optimum matching conditions by providing a means of impedance matching of electromagnetic energy within the container with a resonance window.

A lamp having better efficiency with reduced heat loss from the lamp can be provided by completing a structure with an insulation space on the outside of the lamp.

Furthermore, lamp lighting can be facilitated by providing a means of improving the lamp starting properties within the container with a resonance window.

Electromagnetic energy matching conditions can be easily attained by making the concave reflection mirror of a dielectric material.

The loss due to self-heating can be reduced by making the concave reflection mirror from dielectric material whose dielectric loss at room temperature is under 0.1.

Furthermore, heating due to deterioration brought about by ultraviolet rays or infrared light can be prevented by forming a wavelength selection film on the inside of the concave reflection mirror.

A spot light-source device can be easily produced by having the reflecting mirror form part of the container with a resonance window when the concave reflection mirror is made of metal.

Furthermore, inexpensive electromagnetic energy provision source can be used when a plurality of electromagnetic energy provision sources are used as the means of providing electromagnetic energy, and an extremely economical spot light-source device can be provided.

The emission colors of each lamp can be altered by providing a plurality of lamps within a container with a resonance window, balanced colors can be attained by altering the resonance state of each lamp, and the brightness can be made uniform on the irradiation surface of light irradiated from the spot light-source device.

What is claimed is:

1. A spot light-source device excited by electromagnetic energy comprising a lamp having a discharge envelope made of a translucent non-conducting material with an expansion part enclosing a discharge space, and a tube connected to the expansion part;

a discharge concentrator having a front tip part supported by said tube without protruding from said discharge envelope and facing into the discharge space of said expansion part, said discharge concentrator being constructed to intensify concentration of an electric field in the discharge space and to concentrate discharge;

an electromagnetic energy provision source that excites discharge in said discharge concentrator, said electromagnetic energy provision source being located outside of said lamp;

a concave reflection mirror arranged for reflecting light emitted from said lamp; and a container with a resonance window that creates electromagnetic energy resonance;

wherein said lamp and said concave reflection mirror are housed within said container; and wherein said container is constructed to prevent leakage of electromagnetic energy and has an aperture for collecting and emitting light from said lamp and concave reflection mirror.

2. The spot light-source device excited by electromagnetic energy of claim 1, in which a cylindrical unit protrudes from said container at said aperture, and wherein a rod-like integrator is disposed within said cylindrical unit.

3. The spot light-source device excited by electromagnetic energy of claim 1, in which a plurality of integrator lenses are installed within a lattice reticulated frame at said aperture.

4. The spot light-source device excited by electromagnetic energy of claim 1, in which the discharge concentrator totals one.

5. The spot light-source device excited by electromagnetic energy of claim 1, said discharge concentrator is one of two discharge concentrators that are disposed facing each other, and wherein one of said two discharge concentrators is disposed at a bottom of a curved surface of the concave reflection mirror and is shorter than the other said two discharge concentrators.

6. The spot light-source device excited by electromagnetic energy of claim 1, further comprising a cooling means for cooling said lamp and said concave reflection mirror.

7. The spot light-source device excited by electromagnetic energy of claim 1, further comprising a cover member on an aperture side of said concave reflection mirror to prevent scattering of constituent members of the lamp in case of breakage thereof.

8. The spot light-source device excited by electromagnetic energy of claim 1, further comprising an auxiliary optical system for condensing or reflecting radiated light from said lamp at an aperture side of said concave reflection mirror.

9. The spot light-source device excited by electromagnetic energy of claim 1, in which said lamp is disposed vertically.

10. The spot light-source device excited by electromagnetic energy of claim 1, wherein an aperture is provided at a bottom of a curved surface of said reflection mirror.

11. The spot light-source device excited by electromagnetic energy of claim 1, further comprising means for matching the impedance of electromagnetic energy within the container.

12. The spot light-source device excited by electromagnetic energy of claim 1, further comprising an insulation space outside of said lamp.

13. The spot light-source device excited by electromagnetic energy of claim 1, further comprising means within said container for improving starting of said lamp.

14. The spot light-source device excited by electromagnetic energy of claim 1, in which said concave reflection mirror is made of dielectric material.

15. The spot light-source device excited by electromagnetic energy of claim 14, in which said dielectric material has dielectric loss at room temperature that is less than 0.1.

16. The spot light-source device excited by electromagnetic energy of claim 14 in which a wavelength selection film is formed on an inner surface of said concave reflection mirror.

17. The spot light-source device excited by electromagnetic energy of claim 1, in which said concave reflection mirror is made of metal.

18. The spot light-source device excited by electromagnetic energy of claim 1, wherein the electromagnetic energy provision source comprises a plurality of electromagnetic energy provision sources.

19. The spot light-source device excited by electromagnetic energy of claim 1, wherein additional lamps are provided within said container.

20. The spot light-source device excited by electromagnetic energy of claim 1, in which a coaxial cable is provided for delivering electromagnetic energy from said electromagnetic energy provision source to said container.

21. The spot light-source device excited by electromagnetic energy of claim 1, in which a waveguide is provided for delivering electromagnetic energy from said electromagnetic energy provision source to said container.

22. A spot light-source device excited by electromagnetic energy comprising a lamp having a discharge envelope made of a translucent non-conducting material with an expansion part enclosing a discharge space and without any sealing sections outside of said envelope, and a tube connected to the expansion part;

a discharge concentrator having a front tip part supported by said tube without protruding from said discharge envelope and facing into the discharge space of said expansion part, said discharge concentrator being constructed to intensify concentration of an electric field in the discharge space and to concentrate discharge;

an electromagnetic energy provision source that excites discharge in said discharge concentrator, said electromagnetic energy provision source being located outside of said lamp;

a concave reflection mirror arranged for reflecting light emitted from said lamp; and a container with a resonance window that creates electromagnetic energy resonance;

wherein said lamp and said concave reflection mirror are housed within said container; and wherein said container is constructed to prevent leakage of electromagnetic energy and has an aperture for collecting and emitting light from said lamp and concave reflection mirror.

* * * * *